United States Patent [19]

Kurie et al.

[11] 3,982,327

[45] Sept. 28, 1976

[54] AIR-DISPENSING WEB-FLOATING APPARATUS

[75] Inventors: Eugene J. Kurie, Somerville; Richard J. Yunghahn, Somerset, both of N.J.

[73] Assignee: Midland-Ross Corporation, Cleveland, Ohio

[22] Filed: May 1, 1975

[21] Appl. No.: 573,614

[52] U.S. Cl. ..... 34/156; 226/97

[51] Int. Cl.[2] ..... B65H 17/32

[58] Field of Search ..... 34/156, 160, 57 A, 57 R; 226/97; 302/31, 29, 30; 308/DIG. 1; 214/1 BE

[56] References Cited

UNITED STATES PATENTS

| | | | |
|---|---|---|---|
| 3,319,354 | 5/1967 | Hering, Jr. et al. | 34/160 X |
| 3,475,058 | 10/1969 | Sanders | 302/29 |
| 3,549,070 | 12/1970 | Frost et al. | 34/156 X |
| 3,776,440 | 12/1973 | Frost et al. | 226/97 |
| 3,837,551 | 9/1974 | Schregenberger | 226/97 |

*Primary Examiner*—William E. Wayner
*Assistant Examiner*—Harold Joyce
*Attorney, Agent, or Firm*—Woodrow W. Portz

[57] ABSTRACT

Apparatus including a plurality of pressure pads arranged in two series thereof at opposite sides of a web path and constructed with openings for discharging a gaseous medium against opposite sides of a web advanced along the path. The openings are of types and sizes which enable the two series of pressure pads to dispense the gaseous medium in a manner which achieves good heat transfer but avoids substantial variation in velocity and pressure as measured transversely of the web path in the impingement of a gaseous medium on the web.

5 Claims, 5 Drawing Figures

FIG.1
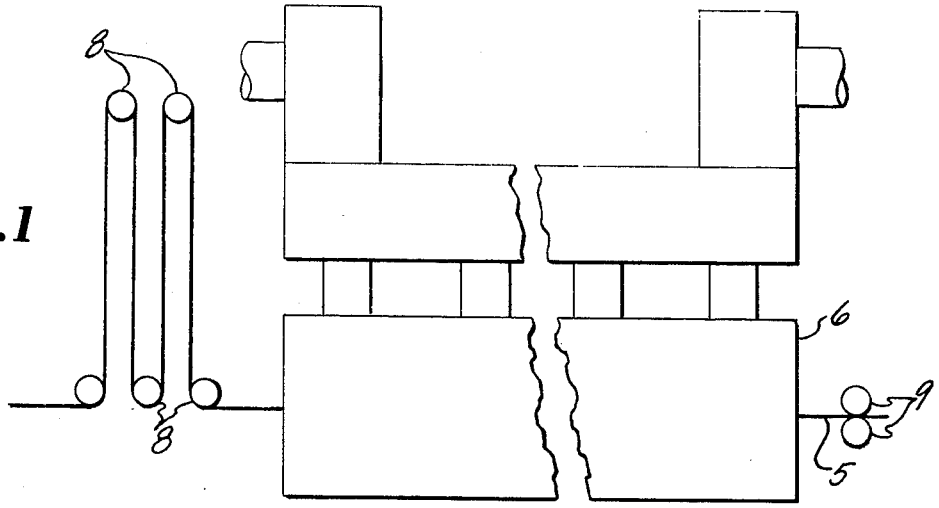
FIG.2
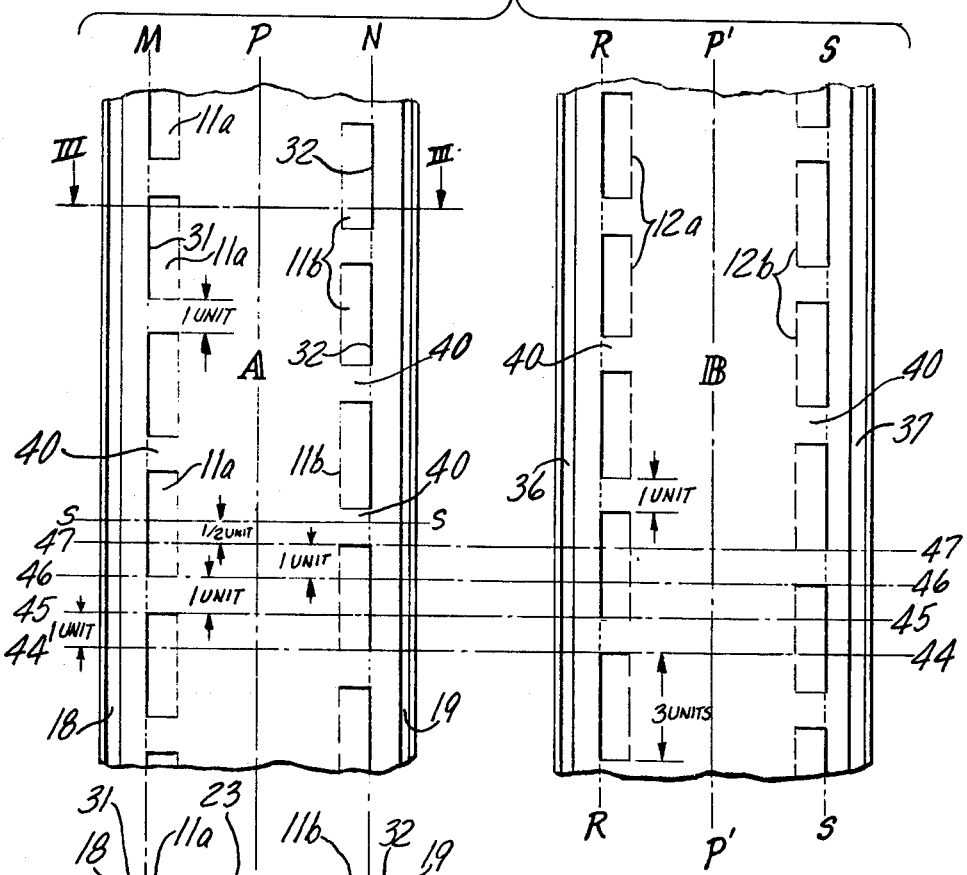
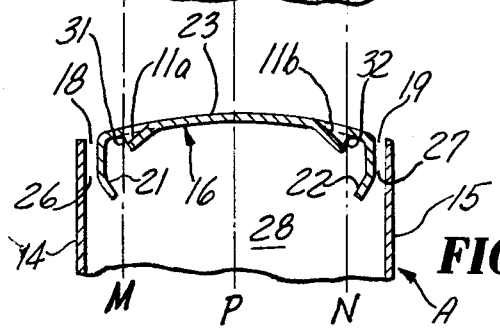
FIG.3

AIR-DISPENSING WEB-FLOATING APPARATUS

BACKGROUND OF THE INVENTION

In the processing of webs of paper, plastics, textile fabrics and the like, a liquid or sticky component or coating of a web may render support thereof during its advancement impractical by any means except a gaseous medium. Examples of an apparatus utilizing a gaseous medium for "floating" such webs are disclosed in U.S. Pat. Nos. 3,837,551; 3,549,070; 3,452,447; and others. In general, the web is supported within an oven or chamber until it has reached a physical state in its linear advancement in which it can be brought into contact with other materials or supporting media. Commercially important parameters of gaseous web suspension are the length of the chamber in which web floating is effected and the processing rate or web travel. For example, chamber lengths of not greater than about 30 feet may be used for economic or space reasons. Some web machinery is paced at linear rates as high as 2000 feet per minute or more. While the apparatus of U.S. Pat. No. 3,837,551 is especially designed, and perhaps superior, for handling the lighter weight webs heretofore encountered in web-treating technology and is notable for achievement of the highest heat transfer rates in the industry, there remains the tendency (1) to cause streaking in some web coatings resulting, it is believed, from the lateral migration of a component in the coating composition, and in other cases, the physical deformation of the coating, and (2) corrugations extending lengthwise of the very weak webs apparently resulting from deformation of the web by impingement of jets thereon issuing from the openings in the pads. Any alteration in pad design tending to alleviate these disadvantages tends to reduce the heat transfer coefficient on transferring heat from the gaseous suspending medium to the web. If the heat transfer coefficient is reduced, the length of the web treating chamber must be extended and/or the rate of web movement reduced.

It is an essential object of the invention to provide equipment for subjecting very weak or thin webs to drying or heat-treating operations by a gaseous medium which are too difficult to satisfactorily process by known apparatus.

Another object is to accomplish the foregoing objects with equipment that affects high heat transfer values between the gaseous medium and the web.

A further object is to devise equipment that will dispense a gaseous medium in a manner which avoids damaging variations in velocity and pressure as measured transversely of the web in the contact of the gaseous medium with the web.

Another object is to provide the equipment of the foregoing objects in a form inexpensively fashioned from sheet material, such as sheet metal shapes, stamping, and the like.

SUMMARY OF THE INVENTION

The invention resides in an apparatus for treating and supporting a web by gaseous medium while being forwarded through the apparatus by nip rolls or other means located exteriorly of the apparatus. The treatment of the web conducted in the apparatus will typically involve the use of a hot gas to dry or expel solvent from the web or the coating thereon, or to polymerize a typical "solventless" coating. The apparatus includes a plurality of pressure pads arranged in two series on opposite sides of a web path especially designed to effect among the highest rates of heat transfer known in the use of air-jet dispensers for floating webs.

The air-dispensing face surfaces of pads in accordance with this invention are of generally rectangular shape with the lengths thereof extending in transverse relation with the web path. Each face surface is perforated by two parallel longitudinal slit-like slots spaced from each other along opposite sides of the face surface, and two rows of louvers located within the area between the slots and forming slit-like openings along rectilinear lines parallel to the slots of which each line of openings is closer to a slot than to the other line of openings. The slots are aligned to discharge air substantially perpendicularly toward the web path whereas the two lines of louver openings of a pad are aligned to discharge air in directions in transverse biased relation to the web path, and biased toward a plane extending between the rows of openings transversely to the web path and generally perpendicularly to the face surface and the web path.

In a preferred form of the invention, the spacing of louvers within a row thereof is about one-third of the length of individual louvers and is a fixed multiple of such spacing. In a single pad, the louvers of one row are staggered with respect to, and in longitudinally overlapping relation with, louvers of the other row to position, in general, each louver of one row opposite a space between louvers of the other row. For example, in a preferred embodiment, lines parallel to the web passing through the midpoints of the lengths of louvers on one roll pass through midpoints of the spaces between louvers of the other row. The pads may be furnished with louvers of equal size and spacing but with the louvers of one set of pads offset from the louvers of another alternate set of pads within the same series by a distance equal to the spacing of adjacent louvers to establish a system of web floatation wherein the louver jets transversely overlap to an extent avoiding streaking as deformation of the web.

BRIEF DESCRIPTION OF THE DRAWING

FIG. 1 is a diagrammatic elevation of apparatus for continuously advancing and treating a web.

FIG. 2 is a fragmentary plan view of two adjacent air-dispensing pads illustrating an offset condition of the louver-type nozzles on one pad in respect to those of the other pad.

FIG. 3 is a fragmentary cross section view in elevation of nozzle-defining structure taken along line III—III of FIG. 1.

DESCRIPTION OF THE PREFERRED EMBODIMENT

Figure 4:
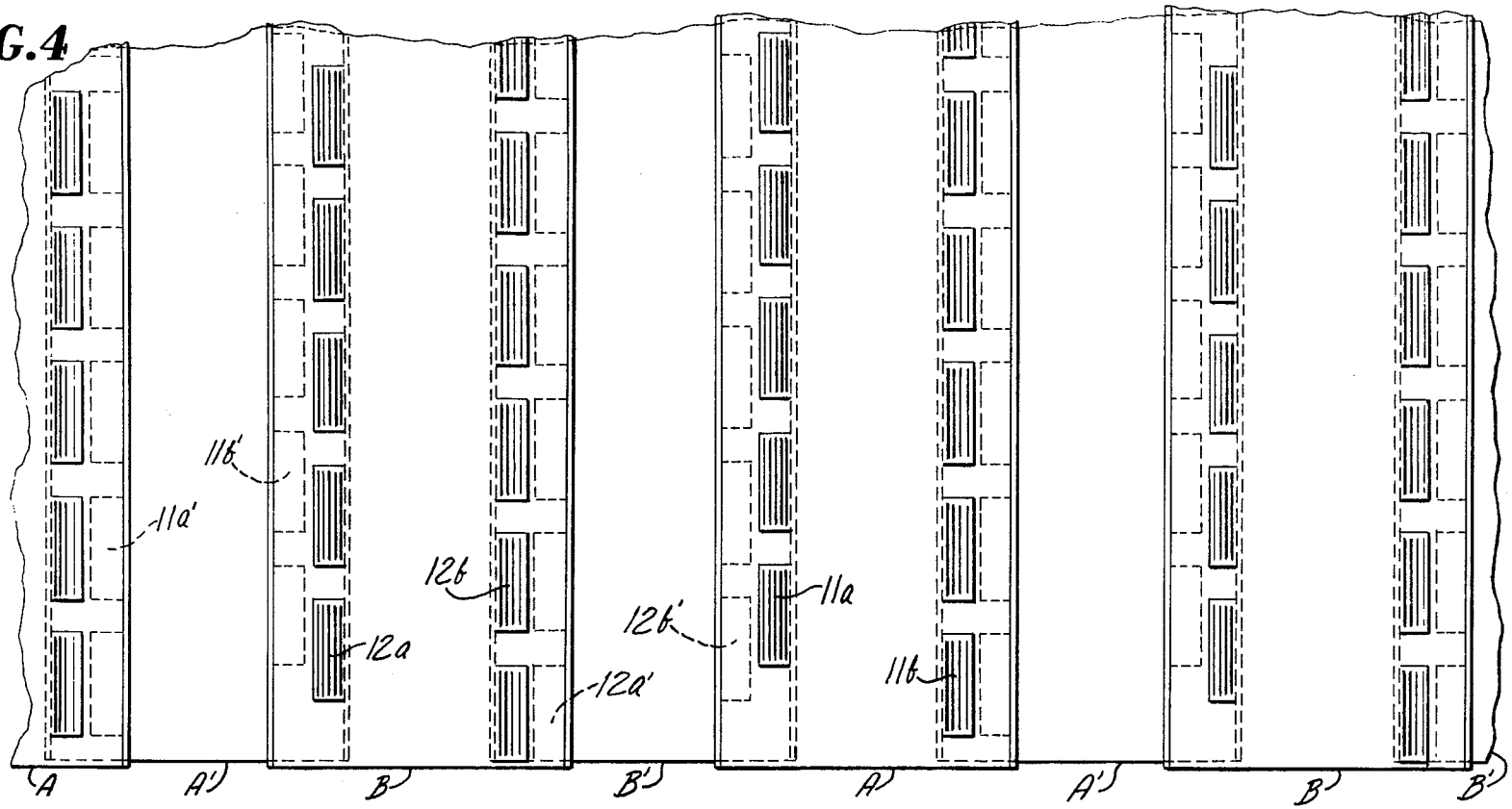
FIG. 4 is a fragmentary plan view of a plurality of pads or air-dispensing devices arranged in an upper series and a lower series with respect to a web path as viewed along line IV—IV of FIG. 5.
Figure 5:
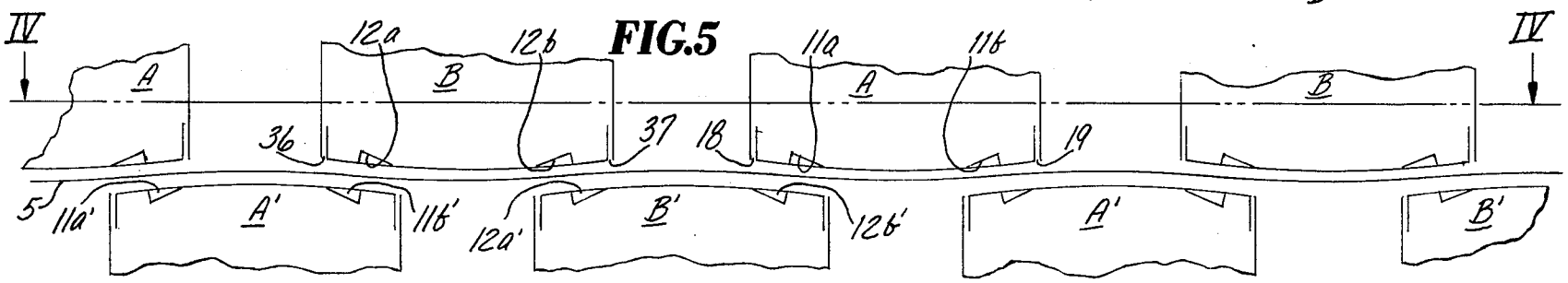
FIG. 5 is an end elevation view of the devices of FIG. 4.

A web 5 may, for example, be advanced through its treating station including an air dryer 6 by rolls 8 disposed in locations developing a serpentine path for the web and/or by nip rolls 9 all operating at a uniform peripheral speed. Chamber 6 contains air-dispensing pads A, B arranged, e.g., as shown in FIGS. 4 and 5. As FIG. 2 shows, pads A and B are similar except for location of louvers 11*a*, 11*b* of pad A and louvers 12*a*, 12*b* of pad B.

Referring now to features common to both types of pads A, B comprises side walls 14, 15 and a face wall 16 shaped and perforated, e.g., by stamping, in such a manner as to provide louvers 11*a*, 11*b* and slots 18, 19.

The face wall 16 may be readily shaped or stamped by conventional sheet metal forming machinery to form in-turned flanges 21, 22 which extend inwardly from the general plane or surface 23 of the wall 16 in spaced relation with side walls 14, 15 to form passageways 26, 27 through which air or other gas can issue from a plenum region 28 of the air-dispensing pad A. The louvers 11*a*, 11*b*, 12*a*, 12*b* typically comprise rectangular depressed areas pressed inwardly from the surface 23 toward the plenum region 28 in a manner causing the rectangular louver portion 31, 32 to slope upwardly from underneath the surface 23 toward a plane P—P extending perpendicularly and transversely of the web path. As shown, plane P—P also approximately bisects surface 23 of the pad A.

In a similar manner, plane P′—P′ bisects the face of the pad B. The row of louvers 11*a* and being depressed from the surface 23 form a series of slit-like openings 31 spaced in end-to-end relationship along a line M—M. In a similar manner, louvers 11*b* form openings 32 along a line N—N. The rows of louvers 11*a*, 11*b* and the slots 18, 19 are thus parallel and symmetrically disposed at opposite sides of the plane P—P. The pad B has slots 36, 37 similar in construction to slots 18, 19, and line R—R and line S—S along which louver openings are located are all parallel to plane P′—P′. As shown, the louvers of pads A and B are spaced along lines M—M, N—N, R—R and S—S by a spacing or distance 40 which is one-third of the length of the louvers.

Further to be noted from FIG. 2 is that an axis S—S extends through a midpoint along the louvers 11*a* within the row of louvers identified by line M—M and through a midpoint of a space 40 occurring between two adjacent louvers 11*b* of line N—N. Thus, in the embodiment shown, the louvers of one row of a pad are in staggered relation with the louvers of the other row with the louvers of one row directly opposite the spaces between the louvers of the other row. Hence, if the louver is regarded as three units long and the space is one unit long, the louvers in one row are staggered longitudinally to an extent of two units out of four with respect to the units of the other row and the opposite end third portions of each louver of one row overlap the end third portions of two louvers of the other row.

FIGS. 2 and 4 illustrate the combination of louver staggering which can be effected through the use of two types of pads A and B in which the louvers of one pad are generally staggered with respect to the louvers of the other pads. Comparing now the louvers 11*a* of line M—M of pad A with the louvers 12*a* along line R—R at the corresponding side of pad B, it can be observed with reference to the dot-dash lines 44, 45, 46, 47 spaced one unit apart that the louvers of ine M—M are staggered in the upward direction of the page one unit with respect to the louvers of line R—R in the next adjacent pad B. In like manner, the louvers 11*b* along line N—N of pad A are staggered upwardly one unit in respect to the corresponding row of louvers 12*b* along line S—S.

FIG. 4 illustrates the distribution of louvers of pads A and B when arranged in two series at opposite sides of a web path illustrated generally by the web 5 in FIG. 5. FIG. 5 shows the two types of pads, i.e., types A and B, with the pads of each type in alternate positions in each series both above and below the web path. In the lower series, the pads are designated as A′ and B′ but are of construction similar to pads A and B, respectively. FIG. 4 illustrates that the louver openings will be periodically staggered at regions progressively along the web path wherein the louvers and slot at one side of a pad occur immediately opposite to the slot and louvers, respectively, of the pad at the other side of the web path. As shown, there is staggering of the louvers on the one side of the web path to overlap the open spaces between louvers on the opposite side of the path at alternate regions along the web path. Such an arrangement avoids any longitudinal strips or areas on the webs which are consistently subjected to abnormal kinetic and high static pressures. This is the arrangement by which air jet streams are applied to the web in such uniformity in kinetic and static pressures, measured transversely of the web as to avoid streaking and corrugating of very light gauge webs is avoided.

The combination of the louvers and the slots of each pad develops a region of gentle turbulence thereover resulting from air issuing from the louvers entrapped by the elongate sheet-like jets of air issuing through the slots in a direction substantially normal to the path of the web. The louver openings have the function of issuing air under high velocity in a well distributed manner to avoid localized kinetic pressures. The air jets from the slots have the further function of reducing or destroying any established air films adjacent the web for the maximizing of heat transfer. In the uncertain and somewhat unpredictable technology of jet-type air-dispensing devices for floating webs, operation of processing equipment comprising pads having the disclosed combination of slot and louvers is found to achieve good heat transfer that cannot be achieved with any known combination of louvers alone or slots alone.

As an example of a typical web floater according to this invention, pads six inches in width in the direction of web travel are mounted two inches apart in each series with the face surfaces extending in or tangent to planes one-half inch apart. The slots are and the louver openings are 0.045 of an inch wide. The ratio of spacing of the louvers to louver length is discretionary. In one installation, the spacing is one-fourth inch with the length of the louvers being one and five-eights inches. The pads of one series are centered opposite the spaces between the pads of the other series. Heat transfer values obtained in the operation, such as web floater, yields approximate values varying from 18.5 Btu's per hour per degree F. per square foot of web side at 0.03 air horse power per square foot of web side to 31 Btu's per hour per degree F. per square foot of web side at 0.3 air horse power per square foot of web side.

What is claimed is:

1. In web treating apparatus having means for supporting a web along a path of movement therefor said apparatus comprising:

a plurality of pressure pads arranged in two series at opposite sides of said path, and having generally rectangular air-dispensing face surfaces spaced lengthwise along said path to face the path and the respective other series with the length of each face surface extending in transverse relation to the web path;

each of said surfaces having a reference plane in transverse perpendicular relation to said path and two substantially rectilinear parallel slots spaced in the lengthwise direction of the path at opposite sides of said plane, and two spaced parallel rows of louvers parallel to said slots located between, and in spaced relation with, said slots at opposite sides of said plane;

each louver being formed of a rectangular area sloping relative to the general plane of said face surface away from said refrence plane inwardly of the pad to form a shoulder with the face surface thereof perforated by a rectilinear elongate slit-like opening contiguous with the interior of the pad and shaped to direct a jet of air upwardly along said sloped area toward said reference plane;

said slots being defined as substantially continuous slit-like elongate openings oriented and shaped to direct air in a direction generally perpendicular to the associated face surface and said web path, said slots and openings having a width not greater than about 0.06 of an inch, said slots and louver openings being contiguous with a common air-supply plenum region within said pad;

a length of each of the louvers, measured lengthwise of the louver rows, being substantially greater than the spacing between adjacent louvers and being a fixed multiple of such spacing, and the louvers of one row of a pad being staggered in respect to, and in longitudinally overlapping relation with, the louvers of the other row to position in general, each louver of one row opposite a space between louvers of the other row.

2. The web treating apparatus of claim 1 wherein:

in each pad, said slots are equidistant, and said rows of louvers are equidistant, from said reference plane of the pad;

said reference plane extends between a pair of pads on the opposite side of said path, said rows of louvers and slots of each pad of a plurality of said pads are located lengthwise of said path to locate a slot and a louver row of one pad at one side of said plane directly opposite the louver row and the slot, respectively, of the pad of said pair at the opposite side of said path and on the same side of said plane.

3. The web treating apparatus of claim 2 wherein:

the midpoints of the lengths of the louvers of one row of a pad occur along lines parallel to the path passing through the midpoints of the spaces between the louvers of the other row of each pad;

said pads are of an A type and a B type differing from each other with respect to occurrence of the louvers relative to the length of the pads;

said pads, when positioned for operation, are arranged with the pads in either series consisting of pads of said types occurring in the same series in alternate positions lengthwise of the path;

each pad having, relative to web movement, an upstream louver row and a downstream louver row, said downstream and said upstream rows of the A type of pads being offset transversely relative to said path with respect to the downstream and upstream rows, respectively, of said B type of pads, a distance at least equal to the spacing of said louvers.

4. The web treating apparatus of claim 3 wherein:

the spacing between adjacent louvers in each row is one-third the length of the louvers.

5. Web treating apparatus according to claim 1 wherein:

a pad has side walls extending transversely of and toward, said web path, and said face surface is defined by a wall forming member having flange portions turned inwardly into said plenum region in spaced relation with the side walls to form said slots, each flange and the adjacent sidewall extending in divergent relationship in a direction inwardly of said region to define a jet-forming passageway from said region terminating in one of said slots.

* * * * *